US010767116B2

(12) United States Patent
Tan et al.

(10) Patent No.: US 10,767,116 B2
(45) Date of Patent: Sep. 8, 2020

(54) METHOD AND COMPOSITION FOR NEUTRALIZING ACIDIC COMPONENTS IN PETROLEUM REFINING UNITS

(71) Applicant: Dow Global Technologies LLC, Midland, MI (US)

(72) Inventors: Runyu Tan, Richwood, TX (US); Lorenzo Spagnulo, Milan (IT)

(73) Assignee: Dow Global Technologies LLC, Midland, MI (US)

( * ) Notice: Subject to any disclaimer, the term of this patent is extended or adjusted under 35 U.S.C. 154(b) by 92 days.

(21) Appl. No.: 15/759,971

(22) PCT Filed: Sep. 26, 2016

(86) PCT No.: PCT/US2016/053657

§ 371 (c)(1),
(2) Date: Mar. 14, 2018

(87) PCT Pub. No.: WO2017/058693

PCT Pub. Date: Apr. 6, 2017

(65) Prior Publication Data

US 2018/0251685 A1 Sep. 6, 2018

(30) Foreign Application Priority Data

Sep. 29, 2015 (IT) ..... 10201556446

(51) Int. Cl.

| | |
|---|---|
| ***C10G 7/10*** | (2006.01) |
| ***C10G 70/00*** | (2006.01) |
| ***C10G 19/02*** | (2006.01) |
| ***C10G 75/02*** | (2006.01) |

(52) U.S. Cl.

CPC ..... *C10G 7/10* (2013.01); *C10G 19/02* (2013.01); *C10G 70/00* (2013.01); *C10G 75/02* (2013.01); *C10G 2300/4075* (2013.01); *C10G 2300/80* (2013.01)

(58) Field of Classification Search

CPC ..... C10G 7/10; C10G 19/02; C10G 70/00; C10G 75/02; C10G 2300/4075; C10G 2300/80

See application file for complete search history.

(56) References Cited

U.S. PATENT DOCUMENTS

| | | | | |
|---|---|---|---|---|
| 2,797,188 | A * | 6/1957 | Taylor, Jr. | C10G 25/02 208/177 |
| 4,594,147 | A * | 6/1986 | Roof | C10G 29/20 208/207 |
| 5,190,640 | A * | 3/1993 | Roof | C10G 29/20 208/189 |
| 5,641,396 | A * | 6/1997 | Braden | C10G 7/10 208/348 |
| 5,885,487 | A * | 3/1999 | Minevski | B01D 53/1456 208/207 |
| 5,965,785 | A * | 10/1999 | Braden | C10G 7/10 208/184 |
| 6,103,100 | A * | 8/2000 | Hart | C10G 9/16 208/252 |
| 7,279,089 | B2 | 10/2007 | Vercammen | |
| 8,048,175 | B2 * | 11/2011 | Yang | C10G 29/20 208/14 |
| 8,177,962 | B2 | 5/2012 | Koizumi et al. | |
| 8,894,843 | B2 * | 11/2014 | Rankin | C10G 7/00 208/208 R |
| 9,493,715 | B2 * | 11/2016 | Subbiah | C10G 19/073 |
| 9,803,149 | B2 * | 10/2017 | Subbiah | C10G 19/073 |
| 2006/0043340 | A1 * | 3/2006 | Koizumi | C02F 5/12 252/387 |
| 2008/0272061 | A1 * | 11/2008 | Hart | B01D 17/047 210/749 |
| 2008/0308770 | A1 * | 12/2008 | Tiwari | C07D 213/04 252/394 |
| 2012/0285864 | A1 * | 11/2012 | Rankin | C10G 7/00 208/220 |
| 2014/0361217 | A1 * | 12/2014 | Moonen | C07C 213/10 252/182.29 |
| 2015/0184086 | A1 * | 7/2015 | Rankin | C10G 29/20 204/558 |
| 2015/0240366 | A1 * | 8/2015 | Arnst | C23F 15/00 422/7 |

OTHER PUBLICATIONS ip.com search (Year: 2019).*

* cited by examiner

*Primary Examiner* — Pamela H Weiss

(57) ABSTRACT

A method of inhibiting corrosion and fouling in petroleum refining units which comprises adding choline hydroxide either alone or in combination with a hydrogen-bond donor such as a carboxylic acid, an amine, an amide, or an alcohol.

7 Claims, No Drawings

METHOD AND COMPOSITION FOR NEUTRALIZING ACIDIC COMPONENTS IN PETROLEUM REFINING UNITS

FIELD OF THE INVENTION

The present invention pertains to a method and composition for neutralizing acidic components in petroleum refining units to inhibit the corrosion of metals therein without resulting in significant fouling of the apparatus.

BACKGROUND OF THE INVENTION

Hydrocarbon feedstocks such as petroleum crudes, gas oil, etc. are subjected to various processes in order to isolate and separate different fractions of the feedstock. In refinery processes, the feedstock is distilled so as to provide the various valuable fractions, e.g., light hydrocarbons, gasoline, naphtha, kerosene, gas oil, etc. The lower boiling fractions are recovered as an overhead fraction from the distillation and vacuum columns. The intermediate components are recovered as side cuts from the distillation column. The fractions are cooled, condensed, and sent to collecting equipment. No matter what type of petroleum feedstock is used as the charge, the distillation equipment is subjected to the corrosive activity of acids such as $H_2S$, HCl, organic acids, and $H_2CO_3$. The problem of corrosion caused by these acid gases as water condenses in the overhead condensing systems of distillation and vacuum columns is well known. The consequent presence of acidic water leads to the undesirable corrosion of metallic equipment, often rapidly.

The general mechanism of this corrosion is an oxidation of metal atoms by aqueous hydrogen ions. The rate of corrosion is directly related to the concentration of aqueous hydrogen ions. A particularly difficult aspect of the problem is that the corrosion occurs above and in the temperature range of the initial condensation of water. The term "initial condensate" as used herein indicates a phase formed when the temperature of the surrounding environment reaches the dew point of water. At this point a mixture of liquid water, hydrocarbon, and vapor may be present. The initial condensate may occur within the distilling unit itself or in subsequent condensers and other equipment. The top temperature of the fractionating column is normally maintained above the dew point of water. The initial aqueous condensate formed contains a high percentage of HCl. The chlorine comes from salts in the crude, and recently the salt content of crude oil (especially Opportunity Crudes) being used in refineries has increased, generating more chlorides. Due to the high concentration of acids dissolved in the water, the pH of the first condensate can be rather low. Thus, as noted, the condensed water can be highly corrosive. It is important that the first condensate is made less corrosive.

Conventionally, highly basic ammonia has been added at various points in the system in an attempt to inhibit the corrosiveness of condensed acidic materials. However, ammonia has not been effective to eliminate corrosion occurring at the initial condensate due to its volatility. In one non-limiting view, ammonia may be ineffective because it does not condense completely enough to neutralize the acidic components of the first condensate.

Amines such as morpholine and methoxy propylamine have been used successfully to control or inhibit corrosion that occurs at the point of initial condensation within or after the distillation unit. Adding amines to the petroleum fractionating system raises the pH of the initial condensate rendering the material substantially less corrosive. The amine inhibitor can be added to the system either in pure form or as an aqueous solution. In some cases, sufficient amounts of amine inhibitors are added to raise the pH of the liquid at the point of initial condensation to above 4.5; in some cases to between 5.5 and 6.5. Other highly basic (pKa>8) amines have been used, including ethylenediamine, monoethanolamine and hexamethylene diamine.

However, the use of these highly basic amines for treating the initial condensate has a problem relating to the resultant hydrochloride salts of these amines which tend to form deposits in distillation columns, column pumparounds, overhead lines, overhead heat exchangers and other parts of the system. These deposits occur after the particular amine has been used for a period of time, sometimes in as little as one or two days. These deposits can cause both fouling and corrosion problems and are particularly problematic in units that do not use a water wash.

Thus, it would be desirable if a method could be devised that neutralizes acid environments in distillation overheads of hydrocarbon processing facilities that minimizes or reduces deposits of hydrochloride and amine salts.

BRIEF SUMMARY OF THE INVENTION

The present invention is a process for neutralizing acidic components in an overhead system of a refining unit comprising water vapor/condensate and petroleum products comprising the step of adding to the system a neutralizing amount of a neutralizing composition comprising an aqueous and/or organic solution of choline hydroxide, preferably wherein the amount of the neutralizing composition ranges from 1 to 10,000 ppm based on the petroleum products.

In one embodiment, the process disclosed herein above further comprising the step of adding one or more hydrogen-bond donor, preferably carboxylic acid, an amine, an amide, or an alcohol, more preferably urea, acetamide, thiourea, m-cresol, or phenol, and more preferably glycerol, and most preferably ethylene glycol.

In one embodiment, the process disclosed herein above further comprising the step of adding one or more alkylamine or alkanolamine, preferably dimethylethanolamine (DMEA), dimethylisopropanolamine (DMIPA), ethylenediamine (EDA), methoxypropylamine (MOPA), monoethanolamine (MEA), dimethylaminopropylamine (DMAPA), morpholine, or trimethylamine (TMA).

In one embodiment of the process disclosed herein above, the choline hydroxide and the hydrogen bond donor are added together in the solution.

In another embodiment of the process disclosed herein above, the solution of choline hydroxide and the hydrogen bond donor are added to the system separately.

In one embodiment the process disclosed herein above further comprises the step of adding the neutralizing composition to the system at a rate sufficient to maintain the pH of water condensate in the system at a pH of equal to or greater than 4, more preferably equal to or greater than 5.

DETAILED DESCRIPTION OF THE INVENTION

Methods and compositions are disclosed for neutralizing acid environments in distillation overhead systems of petroleum product processing facilities, including, but not limited to distillation columns, vacuum distillation columns, preflash towers, and the like. The neutralizer composition comprises an aqueous and/or organic solution of choline hydroxide.

For decades, refiners have struggled with providing adequate neutralization in overhead systems without forming corrosive salts Ammonia and several amines have been tried to control corrosion with random successes and failures. The neutralizer compositions of the invention will allow greater neutralization of corrosive acids in column overhead condensing systems without increasing the potential to form corrosive salts with hydrogen chloride.

The water vapor/condensate coming out of the overhead of the crude distillation unit (CDU) in the refinery is very acidic primarily due to the presence of acidic components, such as hydrochloric acid (HCl), which is formed when the crude oil passes through a heating furnace (composed of metal chlorides such as $MgCl_2$, $CaCl_2$, etc.) prior to entering the CDU. Water vapor and HCl rise to the top of the distillation tower along with the light components of the crude oil such as liquefied petroleum gas and naphtha. This stream passes through an overhead line and then enters a condenser, after which the water stream will be separated from naphtha and off-gas and sent to a water treatment unit. The acidic HCl stream (often having a pH less than 2) is highly corrosive and needs to be neutralized (preferably to a pH of 4 or greater, more preferably 5 or greater). The neutralizing composition is added to the overhead system, traditionally, neutralizers are injected into the overhead system between the CDU and the condenser.

The neutralizing compositions of the present invention bind the hydrogen ions thus reducing their concentration. In one embodiment of the present invention, the neutralizing composition may be added to the overhead system upstream of the aqueous dew point. This addition point is usually the overhead line off of the distillation column or the vapor line off of a dry first condensing stage accumulator.

It will be appreciated that it is not necessary for corrosion in distillation overheads or other equipment to completely cease for the method of this invention to be considered successful. Indeed, the inventive method should be considered operative if corrosion is inhibited to a measurable extent. In the context of this invention, the term "corrosion inhibition" is defined to include any cessation, prevention, abatement, reduction, suppression, lowering, controlling or decreasing of corrosion, rusting, oxidative decay, etc. Similarly, the term "neutralize" refers to such corrosion inhibition by reducing the acidity of the chemicals or components in the system such as by raising pH, but does not require adjusting pH to be 7, but rather raising of pH and moving from acidity to basicity to some measurable extent. Furthermore, the nature of the metal surfaces protected in the methods of this invention is not critical. The metals in which the system operates may include, but are not necessarily limited to iron alloys, copper alloys, nickel alloys, titanium alloys, and these metals in unalloyed form as well, etc.

In one embodiment of the present invention the neutralizing composition is an solution comprising choline hydroxide. The solution solvent may be water, i.e., an aqueous solution, an organic solvent, or mixtures thereof. Suitable organic solvents are alcohols, amines, and ethers, for example glycol and glycol ether. In another embodiment of the present invention the neutralizing composition is an aqueous mixture consisting of only water and choline hydroxide. We believe that when the choline hydroxide encounters HCl in an aqueous environment it is converted to choline chloride which raises the pH in the system.

In a preferred embodiment of the present invention, in addition to the neutralizing composition comprising choline hydroxide, one or more hydrogen-bond donor (HBD) such as carboxylic acids, amines, amides, or alcohols is added to the overhead system. Examples of suitable HBDs are glycerol, ethylene glycol, urea, acetamide, thiourea, m-cresol, and phenol. In one embodiment of the present invention, the choline hydroxide and the one or more HBD are mixed together as a solution prior to being added to the overhead system of the distillation unit. In another embodiment of the present invention, the choline hydroxide solution and the one or more HBD are added separately to the overhead system of the distillation unit.

A deep eutectic solvent is formed by complexing an ammonium compound (e.g., choline chloride) with an HBD. The melting point of a deep eutectic solvent is lower than each of the melting points of the compounds that form it. We believe that when one or more HBD is present in the system in the presence of choline hydroxide in the presence of HCl, an eutectic solvent is formed. These liquids have physical and solvent properties that are similar to ionic liquids formed from discrete ions.

The choline hydroxide is present in the solution in an amount equal to or greater than 1 weight percent to an amount equal to or less than 99.9 weight percent. Preferably, the choline hydroxide is present in the solution in an amount equal to or greater than 1 weight percent, more preferably in an amount equal to or greater than 2 weight percent, more preferably in an amount equal to or greater than 3 weight percent, more preferably in an amount equal to or greater than 5 weight percent, and most preferably in an amount equal to or greater than 10 weight percent. Preferably, the choline hydroxide is present in the solution in an amount equal to or less than 99.9 weight percent, more preferably in an amount equal to or less than 90 weight percent, more preferably in an amount equal to or less than 85 weight percent, more preferably in an amount equal to or less than 80 weight percent, and most preferably in an amount equal to or less than 50 weight percent.

The choline hydroxide to HBD ratio, whether added mixed together or separately, is from 1:2 to 10,000:1. For example, when the HBD is pre-mixed in the solution, it is present in an amount equal to or greater than 0.1 weight percent, more preferably in an amount equal to or greater than 1 weight percent, more preferably in an amount equal to or greater than 2 weight percent, more preferably in an amount equal to or greater than 5 weight percent, and most preferably in an amount equal to or greater than 10 weight percent. Preferably, when the HBD is pre-mixed in the solution it is present in an amount equal to or less than 67 weight percent, more preferably in an amount equal to or less than 50 weight percent, more preferably in an amount equal to or less than 40 weight percent, more preferably in an amount equal to or less than 30 weight percent, and most preferably in an amount equal to or less than 20 weight percent.

It will be appreciated that it is difficult to predict what the optimum dosage rate would be in advance for any particular system. The dosage will depend upon a variety of complex, interrelated factors including, but not necessarily limited to, the exact nature of the stream being fractionated, the temperature and pressure of the distillation conditions, the particular amine blends used, etc. In one non-limiting embodiment of the invention, the dosage rate will be determined on a case-by-case basis depending upon the acid content of the system. It may be desirable to use computer modeling to determine the optimum rate. Nevertheless, to provide some understanding of expected or possible dosage rates, the amount of neutralizing composition may range from 1 to 10,000 ppm, based on the petroleum products. In another non-limiting embodiment, the amount of neutralizing composition may range from 2 to 500 ppm.

The desired pH range for all points in the system is from 4 to 8.5, and in another non-limiting embodiment may be from 5 to 7. Alternatively, to give another idea of expected dosage rates, the neutralizing composition may be added to the system at a rate sufficient to maintain the pH of water condensate in the system at a pH of equal to or greater than 4.0. In another non-limiting embodiment, the neutralizing composition may be added to the system at a rate sufficient to maintain the pH of equal to or greater than 5.0.

The neutralizing composition of the present invention may further comprise one or more alkylamine or alkanolamine, preferably dimethylethanolamine (DMEA), dimethylisopropanolamine (DMIPA), ethylenediamine (EDA), methoxypropylamine (MOPA), monoethanolamine (MEA), dimethylaminopropylamine (DMAPA), morpholine, and trimethylamine (TMA). If present, the one or more alkylamine or alkanolamine is added in an amount of from 1 to 1000 ppm based on the petroleum products.

EXAMPLES

The choline hydroxide is purchased from Aldrich as 20 wt % aqueous solution. The glass apparatus is fabricated by Scientific Glass & Plastic, Inc. The NE-300 Just Infusion Syringe Pump is purchased from New Era Pump Systems Inc. The pH value is monitored by an Orion 720A+ pH meter from Thermo Electron Corporation.

The experimental setup is set up to mimic a CDU. To a 250 mL round bottle is loaded 35% HCl solution with stirring. The bottle is connected to an H-tube with a side sample injection port. The H-tube is further connected with a thermometer, a buffer bottle and a U-tube. The other side of the U-tube is immersed in 50 mL water, the pH value is monitored by the pH meter. A heating mantle is used to boil off HCl. The neutralizer is spray-injected through the side port of the H-tube via a syringe and the injection rate is controlled by the syringe pump. Three experiments are conducted: Comparative Example A, no neutralizer, Comparative Example B, a 5 wt % solution of monomethanolamine, a widely used CDU neutralizer, and Example 1, a 5 wt % aqueous mixture of choline hydroxide with 1 wt % glycerol in water.

The HCl solution is heated to 120° C. and the neutralizer is added at a constant speed by the syringe pump through the sprayer when the pH value of the gas in the outlet starts to drop, to simulate a neutralizer injection on top of a CDU. Upon heating, HCl evolves from the round bottle flask and eventually is dissolved by water in the beaker or neutralized by the neutralizer and stays in the buffer bottle in the form of chloride salt. The pH value of the water in the beaker is indicative of the neutralization efficiency. The pH of the vapor in the outlet is monitored by a pH meter. Table 1 shows the pH value change of the water in the beaker versus time.

TABLE 1

| Time, minutes | Com Ex A | Com Ex B | Ex 1 |
|---|---|---|---|
| 1 | 5.9 | 5.9 | 5.9 |
| 2 | 5.8 | 5.8 | 5.8 |
| 3 | 5.7 | 5.7 | 5.7 |
| 4 | 5.4 | 5.0 | 5.2 |
| 5 | 5.3 | 4.8 | 5.2 |
| 6 | 5.2 | 4.8 | 5.1 |
| 7 | 5.1 | 4.8 | 5.1 |

TABLE 1-continued

| Time, minutes | Com Ex A | Com Ex B | Ex 1 |
|---|---|---|---|
| 8 | 5.0 | 4.5 | 5.0 |
| 9 | 5.0 | 4.3 | 5.0 |
| 10 | 3.5 | 4.1 | 4.5 |
| 11 | 2.8 | 4.0 | 4.4 |
| 12 | 2.1 | 4.0 | 4.4 |
| 13 | 1.8 | 4.0 | 4.2 |
| 14 | 1.6 | 4.0 | 4.2 |
| 15 | 1.3 | 4.0 | 4.2 |

Without neutralizer, the pH value of the water decreased slowly to around 4.0 in the first 10 minutes and dropped dramatically and quickly afterwards, suggesting HCl started to evolve rapidly at that point, consistent with the temperature rise observed on top of the HCl solution in the round bottle. The neutralizer compositions, Comparative Example B and Example 1, are spray-injected after the round bottle is heated for 10 minutes as well. As can be seen, the pH value stayed above 4.0 during the course of the experiments. No solid deposition is observed. The experimental data suggests that choline hydroxide effectively neutralizes HCl vapor.

Example 2

The viscosity of a mixture of ethylene glycol and choline chloride in a 2:1 mole ratio is measured in an Anton Paar SVM 3000/G2 Stabinger Viscometer at various temperatures. As shown in Table 2, the viscosity of this mixture is below 30 cP at 20° C. and is 3.36 cP at 100° C.

TABLE 2

| Temperature, ° C. | Dynamic viscosity, cP |
|---|---|
| 20 | 29.00 |
| 30 | 19.70 |
| 40 | 13.97 |
| 50 | 10.31 |
| 60 | 7.86 |
| 70 | 6.16 |
| 80 | 4.94 |
| 90 | 4.04 |
| 100 | 3.36 |

What is claimed is:

1. A process for neutralizing acidic components in a distillation overhead system of a refining unit comprising water condensate and petroleum products, the process comprising:

adding to the distillation overhead system a neutralizing amount of a neutralizing composition comprising an aqueous solution of choline hydroxide and an hydrogen-bond donor, the hydrogen bond donor being glycerol, the distillation overhead system including an overhead line off of a distillation column and the neutralizing composition being added in the overhead line.

2. The process of claim 1 wherein the choline hydroxide and the hydrogen bond donor are mixed together prior to being added.

3. The process of claim 1 wherein the solution of choline hydroxide and the hydrogen bond donor are added to the system separately.

4. The process of claim 1 further comprising the step of adding one or more alkylamine or alkanolamine.

5. The process of claim 4 wherein the alkylamine or alkanolamine is dimethylethanolamine (DMEA), dimethylisopropanolamine (DMIPA), ethylenediamine (EDA), methoxypropylamine (MOPA), monoethanolamine (MEA), dimethylaminopropylamine (DMAPA), morpholine, or trimethylamine (TMA).

6. The process of claim 1 wherein the amount of the neutralizing composition ranges from 1 to 10,000 ppm based on the petroleum products.

7. The process of claim 1 further comprising the step of adding the neutralizing composition to the system at a rate sufficient to maintain the pH of water condensate in the system at a pH of equal to or greater than 4.0.

* * * * *